US008517144B2

(12) United States Patent
Cuccurullo et al.

(10) Patent No.: US 8,517,144 B2
(45) Date of Patent: Aug. 27, 2013

(54) HATCHWAY SAFETY GRAB POST SAFETY BARRIER AND GRATE

(76) Inventors: Joseph Cuccurullo, Houston, TX (US); Dante Cuccurullo, Hockley, TX (US)

( * ) Notice: Subject to any disclaimer, the term of this patent is extended or adjusted under 35 U.S.C. 154(b) by 161 days.

(21) Appl. No.: 12/803,343

(22) Filed: Jun. 24, 2010

(65) Prior Publication Data

US 2010/0326769 A1 Dec. 30, 2010

Related U.S. Application Data

(60) Provisional application No. 61/269,818, filed on Jun. 30, 2009.

(51) Int. Cl.
*E06C 9/08* (2006.01)
*E04H 17/14* (2006.01)

(52) U.S. Cl.
USPC ..... 182/97; 182/45; 49/386

(58) Field of Classification Search
USPC ..... 52/20; 49/386; 248/292.14; 182/45, 182/97
See application file for complete search history.

(56) References Cited

U.S. PATENT DOCUMENTS

| | | | | |
|---|---|---|---|---|
| 2,734,708 | A * | 2/1956 | Cohn | 248/517 |
| 4,298,071 | A * | 11/1981 | Whitfield et al. | 172/624 |
| 6,167,659 | B1 * | 1/2001 | Swindell, III | 52/20 |
| 6,378,819 | B1 * | 4/2002 | Johnson | 248/214 |
| 6,640,495 | B1 * | 11/2003 | McKernan | 49/67 |
| 6,688,046 | B2 * | 2/2004 | Perkins | 52/19 |
| 2009/0095944 | A1 * | 4/2009 | Gaines | 254/334 |
| 2010/0031573 | A1 * | 2/2010 | Whiting et al. | 49/31 |

* cited by examiner

*Primary Examiner* — Alvin Chin Shue
(74) *Attorney, Agent, or Firm* — James L. Jackson

(57) ABSTRACT

A lift-up safety grab post mechanism for rooftop hatchway curbs having a mounting bracket on a hatchway curb and having an elongate opening having a pivot bolt for upward and downward grab post movement. A lift-up grab post has a pivot opening receiving the pivot bolt and having a stop member fixed thereto. The lift-up grab post is rotationally moveable between an upstanding position and a horizontal position relative to the roof hatchway curb. The mounting bracket defines a receiver seat and further defines a stop shoulder adjacent the receiver seat that prevents rotational movement of the grab post until the grab post has been raised from said receiver seat to a position above the stop shoulder.

5 Claims, 5 Drawing Sheets

FIG. 3
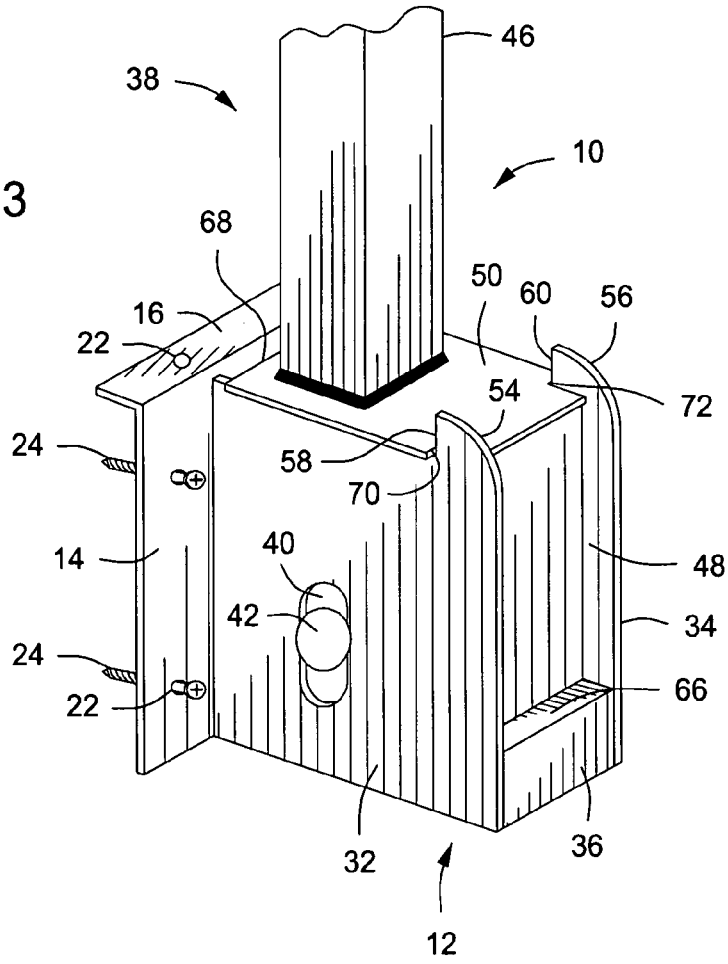
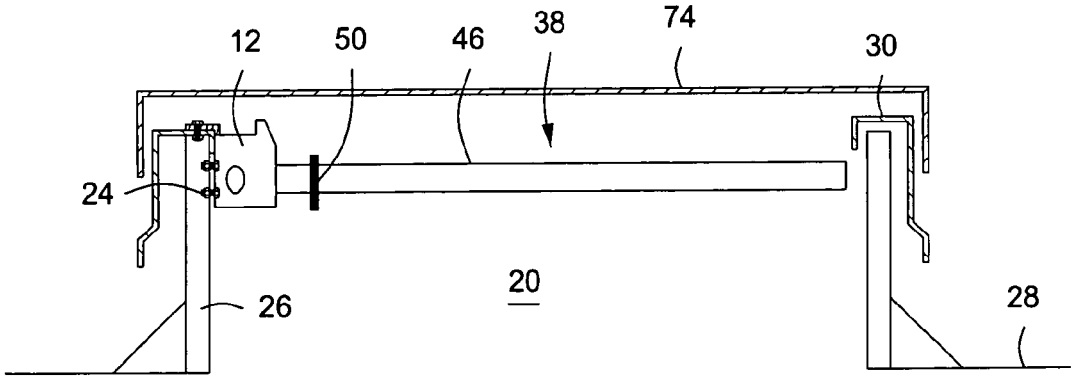
FIG. 4

HATCHWAY SAFETY GRAB POST SAFETY BARRIER AND GRATE

RELATED PROVISIONAL APPLICATION

Applicant hereby claims the benefit of U.S. Provisional Patent Application No. 61/269,818, filed on Jun. 30, 2009 by Joseph Cuccurullo and Dante Cuccurullo and entitled "Hatchway Safety Grab Post and Grate", which Provisional Patent Application is incorporated by reference herein for all purposes.

BACKGROUND OF THE INVENTION

1. Field of the Invention

The present invention relates generally to safety systems for roof access hatchways to protect workers from falls and prevent injuries. More particularly, the present invention concerns a safety lift-up grab post that is moveable between a stowed, out of the way position and an upstanding position where it may be grasped by persons to steady themselves and enable themselves to move more safely through a rooftop hatchway. Even more particularly, the present invention concerns assembly of other safety devices, such as rails, chains, gates, grating, etc. to provide for a more safe rooftop access.

2. Description of the Prior Art

Roof access hatchways are typically provided with various safety devices such as safety rails that are attached to the roof of a building or attached to the typically rectangular curb structure of a hatchway system. For the most part these safety rails are permanently fixed and, though they are obviously needed for protecting workers from falls through an open hatchway, at times they constitute an impediment to movement of workers, tools and equipment to and from the roof. It is desirable to provide roof hatchway safety systems that can be moved to an out of the way position, when necessary, so that a hatchway can be unobstructed when special circumstances dictate. And, when hatchway safety devices are moved to an out of the way position, it is desirable that the safety devices establish other safety factors that protect workers from injury by falls, dropping equipment, etc.

SUMMARY OF THE INVENTION

It is a principal feature of the present invention to provide a novel lift-up safety grab post extension assembly that is mounted to a roof hatch curb and permits a grab post to be easily and simply moved between a lowered position permitting closing of a hatch cover and an upstanding and stabilized position enabling it to be grasped by workers to enhance worker safety as they pass through the hatch opening.

It is another feature of the present invention to provide a novel lift-up safety grab post extension assembly that can be provided with safety rail and/or safety grating attachments to enhance the safety of hatch openings.

Briefly, the various objects and features of the present invention are realized through the provision of a lift-up safety grab post extension assembly mounted onto an existing roof hatch or floor opening with a curb mount plate includes a lift-up grab post extension assembly, curb mounting plate that mounts with fasteners to the existing metal or concrete floor structure opening, a post when lifted into place sets into a notched receiver and locks to hold the post in place for safe access through a floor or roof opening. Part of this device includes two side wall plates as part of the hinged bracket welded to the curb mounting plate. The side wall bracket consists of a slotted hole to receive a bolt and nut to be used as a hinge for an inserted post as a part of the assembly. The side wall bracket as part of its design has an upper recess with a stop ledge and a sloped front edge as a guide for the post stop plate.

The post is a tube either round or square with a hole to receive the mounting bolt hinge, a stop plate is welded to the post so that when the post is lifted upward it glides on the sloped edge to the top of the side wall bracket until the post is fully extended the stop plate falls into the notched receive and holds in place until the post needs to retracted. To retract the safety grab post by lifting upward and lowered into the hatchway opening.

The lift-up safety grab posts enable significant flexibility of hatchway access arrangement. For example, two safety grab posts may be mounted on either side of the hatchway opening with curb mount plates for raising and lowering according to the principles of the present invention. The two grab posts may be adapted to receive attachments to form an enclosure or a series of rungs forming a ladder. Apparatus forming an extended ladder when the grab posts are raised and locked in position, also define a safety grating when the grab posts are in their lowered or closed position, thereby protecting workers from falls inward through the hatchway opening.

Side safety barriers for a hatchway may be defined using two safety grab posts and side rail attachments or chain on each side to form a protective enclosure. The forward opening between the safety grab posts can receive a chain attachment or a gate to safeguard all sides of the hatch opening when the hatchway door is open. When the safety grab post assembly is lowered to its closed position the gate or chain will serve as a grating to protect workers from falls inward through the open hatchway.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is an isometric illustration showing a mounting bracket for a lift-up safety grab post embodying the principles of the present invention;

FIG. 2 is an isometric illustration showing a lift-up safety grab post member for support by the mounting bracket of FIG. 1

FIG. 3 is an isometric illustration showing the mounting bracket of FIG. 1 with the lift-up safety grab post of FIG. 2 in lifted and locked relation therewith;

FIG. 4 is a sectional view of a hatchway curb with the mounting bracket of FIGS. 1 and 3 mounted therein and showing the lift-up safety grab post of FIG. 2 being shown in its lowered position, permitting closing movement of the hatchway closure member;

FIG. 5 is an isometric illustration showing a hatch closure in its open condition and with the lift-up safety grab post member being supported in its upstanding condition by said mounting bracket;

FIG. 6 is a partial side elevation view showing a roof hatch closure being in its open condition and showing by way of arrows the lifting and rotating movement of the lift-up safety grab post to its upstanding locked position relative to the mounting bracket;

Figure 7:
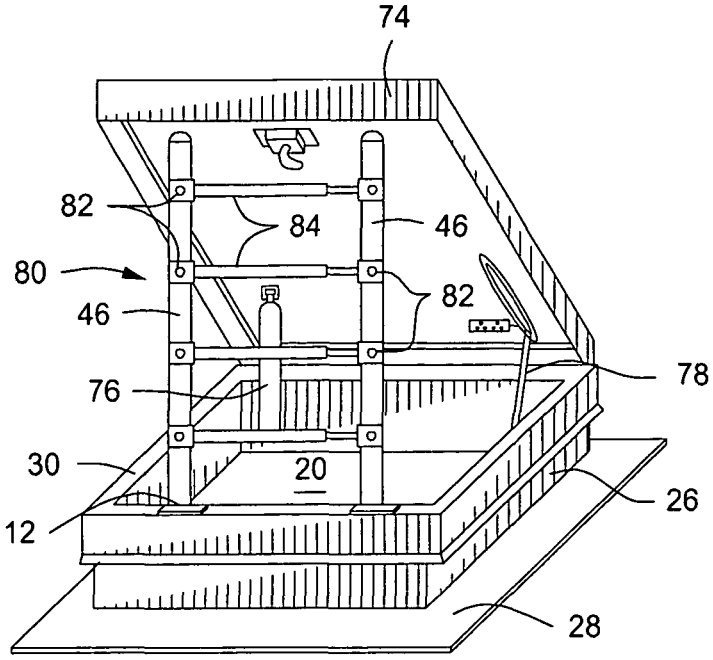
Figure 8:
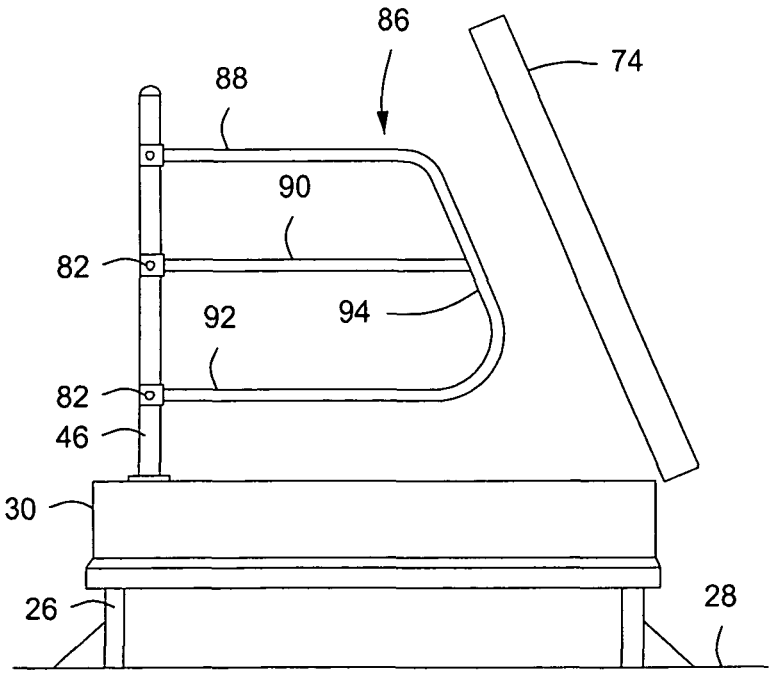
Figure 9:
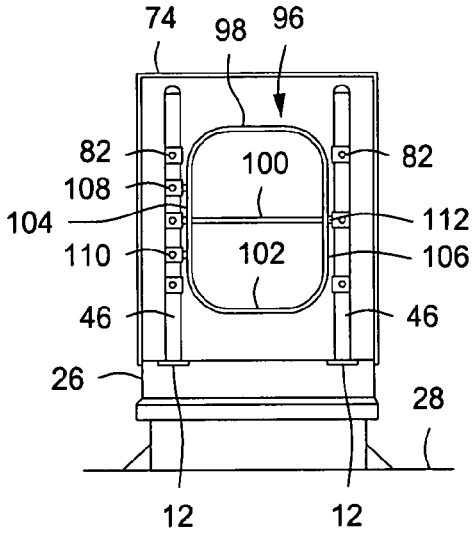
Figure 10:
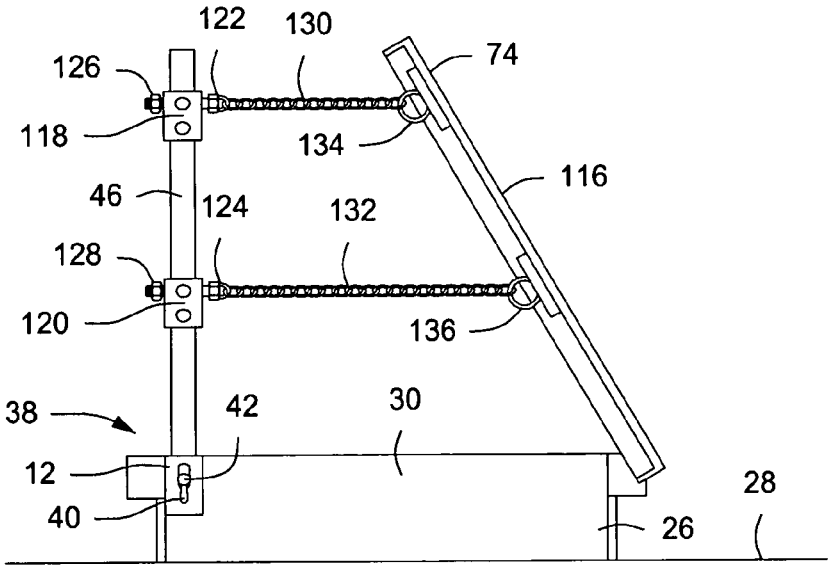
Figure 11:
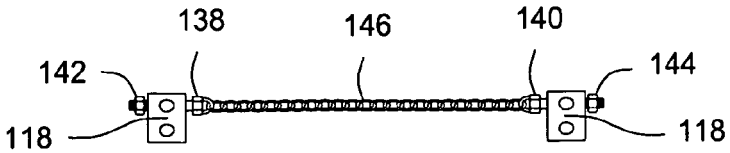

FIG. 7 is an isometric illustration showing a roof hatch closure in its open condition and showing a lift-up safety grab post and safety barrier assembly representing an alternative embodiment of the present invention and being shown in its lifted and latched condition to define a protective enclosure and when lowered defines a ladder or grating preventing worker falls through the hatchway opening;

FIG. 8 is a side elevation view of a roof hatch being shown with its closure member in its open condition and showing a lift-up safety grab post and safety barrier assembly being maintained at its upstanding position and with side safety rails being mounted to and moved by the lift-up safety grab posts, thus forming a side barrier assembly at the hatchway opening;

FIG. 9 is a front elevation view showing a roof hatch with its closure in the open position and with a pair of lift-up safety grab posts supporting a protective side railing that is moved to its active position and is lowered to its stowed position along with raising and lowering movement of the lift-up safety grab posts;

FIG. 10 is a side elevation view of a roof hatch being shown with its closure member in its open condition, with a pair of lift-up safety grab posts being shown in the upstanding and locked positions thereof and with side protecting chain members being shown with ends connected with the lift-up safety grab posts and connected with mounting brackets of the hatchway closure; and FIG. 11 is a partial elevation view showing mounting structure for mounting flexible safety chain members to spaced lift-up grab posts to form a safety barrier therebetween.

DETAILED DESCRIPTION OF PREFERRED EMBODIMENT

Figure 1:
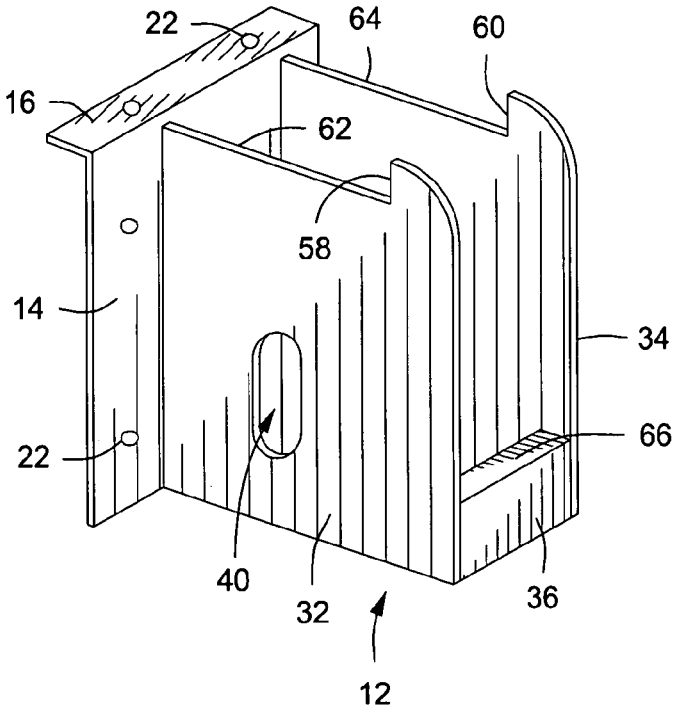
Figure 2:
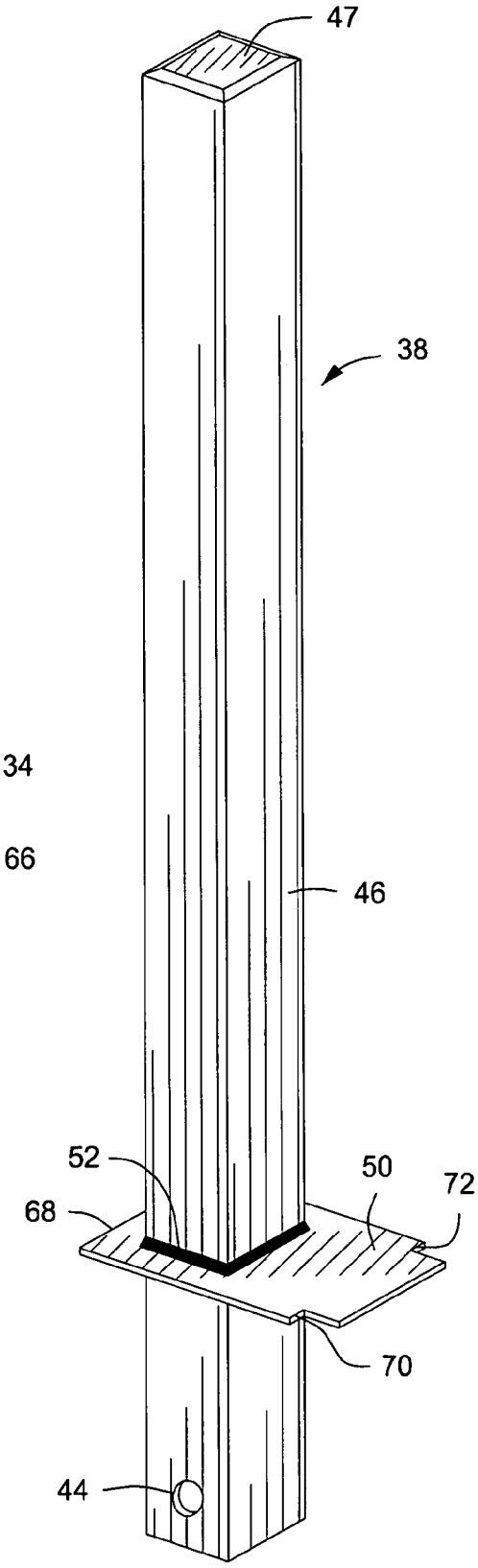

Referring now to the drawings and first to FIGS. 1-3, a lift-up safety grab post assembly constructed according to the principles of the present invention is shown generally at 10 in FIG. 3 and incorporates a mounting bracket, shown generally at 12. The mounting bracket 12 consists of a curb mounting plate 14 having an upper generally horizontally oriented flange 16 that rests on the upper horizontal surface of a roof mounted curb assembly such as is shown at 18 in FIGS. 4-6 and which defines a hatchway opening 20. The curb mounting plate 14 and its upper generally horizontally oriented flange 16 define retainer holes 22 that receive screws, nails or other suitable retainers 24 that secure the mounting bracket 12 to the inner and upper structure of the hatchway curb as shown in FIGS. 4 and 6. The roof mounted curb assembly 18 typically incorporates curb front, rear and side members 26 as shown in FIGS. 4 and 6 that project upwardly from a roof structure 28. The upper portions of the curb side members 26 are typically covered by curb flashing 30. The upper flange 16 of the curb mount plate typically rests on the curb flashing, with retainers extending through the retainer holes 22 and through the flashing and engaging within the upper portions of the front curb member 26.

The mounting bracket 12 incorporates a pair of generally parallel side plates 32 and 34 that are fixed to the curb mount plate 14 by means of welding or by any other suitable form of attachment. The spaced and parallel relation of the side plates 32 and 34 are maintained by the fixed relation of the side plates with the curb mount plate and by means of a rest bar 36 that is positioned between the side plates and is fixed to both side plates by means of welding or by any other suitable form of attachment.

Figure 5:
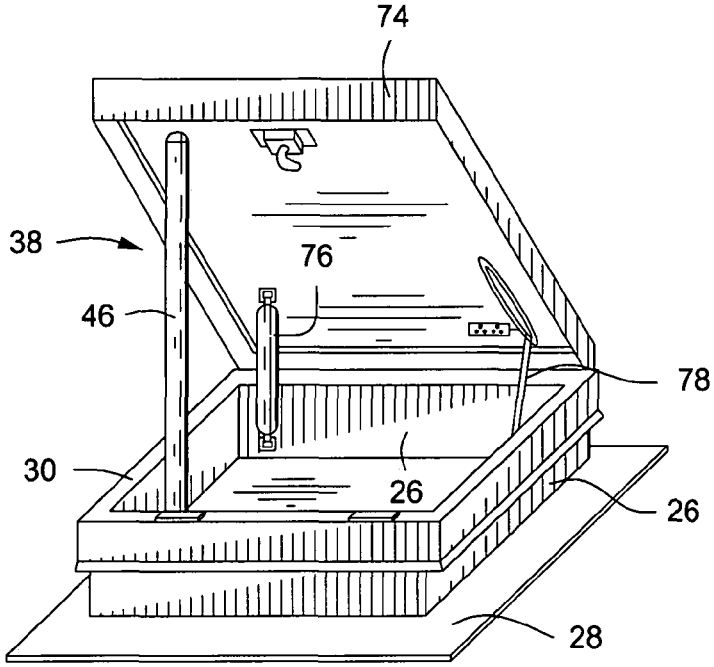
Figure 6:
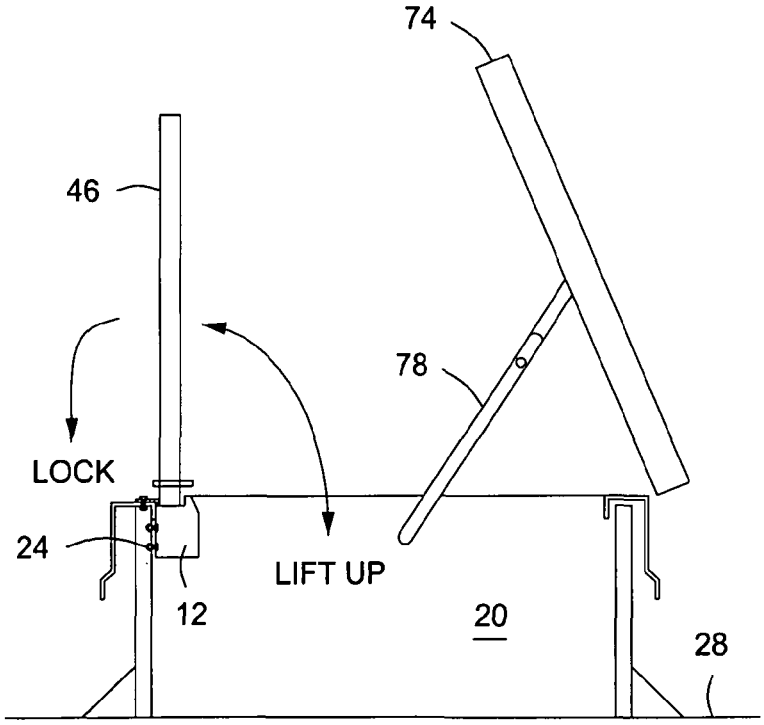

A grab post assembly shown generally at 38 in FIG. 2 is intended to be mounted so as to permit its movement between an upstanding and locked position shown in FIGS. 3, 5 and 6 and a lowered or closed position as shown in FIG. 4. To enable these features the side plates 32 and 34 of the mounting bracket 12 each define an elongate slotted hole 40. A hinge and movement control bolt member 42 extends through the aligned elongate slotted holes 40 of the side plates and extends through bolt holes 44 that are defined in the lower portion of a tubular grab post 46 of the grab post assembly 38 that is positioned in the space 48 between the side plates 32 and 34 of the mount bracket 12. A stop plate 50 defines a central opening 52 receiving the grab post 46 and a weld bead or other suitable form of attachment establishes mounting of the stop plate to the grab post as shown in FIG. 2. The grab post 46 is provided with a post cap 47 at its upper end to ensure against entry of water or other debris into the grab post and to ensure against the presence of any sharp edges that might represent a danger to workers.

The side plate members 32 and 34 each define substantially angulated or inclined guide edges 54 and 56. If desired, the guide edges may be of arcuate or curved configuration essentially as shown in FIGS. 1 and 3 or may be defined by inclined straight edge segments without departing from the spirit and scope of the present invention. The upper portions of the side plate members each define a stop ledge 58 and 60 forming stop shoulders and defines notch edges 62 and 64 on which the stop plate 50 rests after the grab post 38 has been raised to its upstanding position and lowered to seated position on the notch edges. With the grab post 38 upstanding and seated as shown in FIG. 3 force applied to the grab post toward the hatch opening will be resisted by the stop shoulders 58 and 60 and force applied in a direction away from the hatch opening will be resisted by that portion of the curb mount plate 14 that extends upwardly from the level of the notch edges 62 and 64.

To cause closing or lowering movement of the grab post 38 from the locked position shown in FIG. 3 an upward force is applied to the grab post raising it until the stop plate 50 has moved above the level of the stop shoulders 58 and 60, thus causing upward movement of the hinge bolt 44 within the elongate slotted opening 40. The grab post is then free to be moved in essentially pivotal manner to the lowered or closed position shown in FIG. 4. When at its lowered or closed position a portion of the grab post between the hinge bolt 40 and the stop plate 50 will engage the upper surface 66 of the rest bar 36 so that the grab post will not move below the closed position of FIG. 4 and will be adequately supported in readiness for movement from the closed position to its open position.

For movement of the grab post assembly 38 from its closed position of FIG. 4 to its open or upright position shown in FIG. 3 the grab post 46 is simply raised and rotated about the pivot arrangement that is established by the hinge bolt and the elongate or slotted holes 40 of the side plates 32 and 34. As this rotational movement of the grab post continues a leading edge 68 of the stop plate 50 will contact the inclined guide edges 54 and 56 of the side plates and will guide the stop plate, permitting its essentially pivotal rotation to its upstanding position. The stop place during such pivotal rotation will move over the stop ledges or shoulders 58 and 60 until the trailing edge segments 70 and 72 of the stop plate move clear of the stop ledges or shoulders 58 and 60. At this point the grab post assembly will descend by gravity until the lower surface of the stop plate 50 comes into supported relation with the notch edges 62 and 64. The lifting and locking movement of the grab post assembly is shown by movement arrows in FIG. 6. When the stop plate of the grab post assembly has become seated and supported by the notch edges of the side plates it can be rotated from this position only after it has been lifted to a position where the stop plate is located above the stop ledges or shoulders 58 and 60. A worker moving through the hatch opening FIGS. 4, 5 and 6 illustrate the positions of the lift-up safety grab post or posts in relation with the structure of a conventional roof access hatch mechanism. As shown, the closure or cover 74 of the roof hatch mechanism is shown pivoted from the closed position in FIG. 4 to its open position as shown in FIGS. 5 and 6. The hatch cover 74 may be provided with a pneumatic or hydraulic cylinder 76 that ensures that closing movement of the closure will be controlled, so that a worker can release the closure and permit it to be slowly closed by the force of gravity, rather than simply falling to its closed position. A jointed brace member 78 may be provided to permit the closure to be supported or locked at its open position when it is desired that the closure remain open for a desired period of time.

With reference now to FIGS. 7-11 the lift-up grab post mechanism of the present invention can be employed in association with a variety of other hatchway safety features to further enhance the safety and reliability of hatchway systems. As shown in FIG. 7 a ladder system is shown generally at 80 and comprises a pair of lift-up grab posts 46. A plurality of ladder rung support brackets 82, which may be in the form of clamp devices, are secured to the grab posts and provide support for respective ends of ladder rung members 84. The ladder rung members 84 may have adjustable length as shown in FIG. 7 to permit the lift-up grab posts 46 to be spaced as desired. The ladder rung members and their support brackets are of sufficient structural integrity to permit a worker to climb them or to grasp them with the hands to provide for safe and stabilized worker movement through the hatchway opening 20.

When it is desirable to close the hatchway from the open condition shown in FIG. 7, the lift-up grab post ladder assembly will be lifted up to move the stop plates 50 of each of the grab post assemblies clear of the stop ledges or shoulders 58 and 60. At this point the entire lift-up grab post ladder assembly will be pivotally moved to its closed position so that it will essentially cover the entire hatchway and serve as a protective safety grate to prevent workers or equipment from falling through the open hatchway. The rest bars 36 of each mounting bracket will support the ladder assembly in a substantially horizontal position without the need for any additional supports. In the event it should be desired to accomplish pivotal movement of the ladder assembly to a downwardly extending position within the hatchway the mounting brackets can be modified to eliminate the rest bar 36. Use of the ladder assembly as a safety grate can then be accomplished by providing the ladder assembly or the roof hatch structure with a support structure that can be easily positioned to support the ladder assembly at a substantially horizontal position.

As shown in FIG. 8 it may be desirable to provide the grab post or ladder arrangement of FIG. 7 with a safety side rail structure shown generally at 86. The support brackets 82 will be adapted for support of safety rail members 88, 90 and 92. The safety side rail assembly 86 will also include other rail structures such as shown at 94 that integrate the rails to form a protective side rail assembly on each side to the roof hatchway.

With regard to FIG. 9 the lift-up grab post arrangement of the present invention lends itself to the provision of an access control gate assembly, shown generally at 96. Upper, intermediate and lower gate rail members 98, 100 and 102 are shown to be connected with gate side rail members 104 and 106 to define a gate assembly that serves as a hatchway access gate and also serves as a safety grate structure, depending on the position of the lift-up grab posts 46. Gate support and pivot brackets 108 and 110 are mounted to the lift-up grab posts 46 and provide for pivotal movement of the gate assembly 96. A gate latch member 112 is mounted to the gate rail member 106 or to a post bracket member and serves to control opening of the gate assembly. When it is desirable to close the hatchway from the open condition shown in FIG. 9, the lift-up grab post gate assembly 96 will be lifted up to move the stop plates 50 of each of the grab post assemblies clear of the stop ledges or shoulders 58 and 60. At this point the entire lift-up grab post gate assembly can be pivotally moved to its closed position so that it will essentially cover and block the entire hatchway and serve as a protective safety grate to prevent workers or equipment from falling through the open hatchway.

Referring now to FIGS. 10 and 11, it is desirable to provide for use of the lift-up grab post system of the present invention for the provision of chain type hatchway safety guard assembly for rooftop hatchways. Lift-up grab post mechanisms 38 are substantially pivotally mounted by mounting brackets 12, which are mounted internally of the hatchway curb as shown in FIGS. 4 and 6. When the lift-up grab posts 46 are raised and pivotally moved to the horizontal or closed positions, the lift-up grab posts will essentially lie along the interior surface of the hatchway curb 74 in generally parallel relation with the upper edge of the curb. Pairs of mounting brackets 118 and 120 are secured to the lift-up grab posts and have chain connector members 122 and 124 mounted thereto by means of mounting bolts 126 and 128. Side guard safety chains 130 and 132 or other suitable safety side guard members have one of the ends thereof connected with the chain connector members 122 and 124. The opposite ends of the safety chains 130 and 132 are connected with chain support members 134 and 136 that are mounted to an internal surface portion of the hatchway closure member 74. Chain connector members 138 and 140 are mounted to the mounting brackets 118 and 120 by mounting bolts 142 and 144 connected therewith and provide support for front opening chain guard members 146.

The side guard safety chains 130 and 132 are arranged to be easily disconnected from one or both chain connectors if desired. However, the side guard chains will simply extend downwardly within the hatchway when the lift-up grab posts have been lowered to their closed positions. For closure, each of the lift-up grab posts will then be lifted to position the stop plate clear of the stop shoulders and the posts will then be essentially pivotally lowered to their closed positions. If desired the side guard safety chains 130 and 132 may be disconnected from the closure member 74 and may be rearranged with respect to the front opening chain guards and the lift-up grab posts to provide a chain grating essentially covering the hatch opening for the protection of workers.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A lift-up safety grab-post mechanism for rooftop hatchway curbs, comprising:

a generally rectangular hatchway curb being mounted to a roof structure at a hatchway opening and defining a substantially vertical internal curb surface and a substantially horizontal upper curb surface;

a grab-post mounting bracket being mounted to said generally rectangular roof hatchway curb and having a pair of spaced side members each defining an elongate substantially vertically oriented opening said substantially vertically oriented openings being in substantially horizontal registery;

a lift-up grab post having a portion thereof located between said spaced side members and having a generally horizontally oriented pivot opening;

a pivot bolt member extending through said generally horizontally oriented pivot opening and having end portions located within said substantially vertically oriented openings and permitting upward downward and rotational movement of said grab-post relative to said grab-post mounting bracket, said lift-up grab post being rotationally moveable between an open position where said lift-up grab post is oriented substantially vertically and a closed position where said lift-up grab post is oriented substantially horizontally within the roof hatchway curb;

a support plate being mounted to said lift-up grab post and being oriented in substantially normal relation with said lift-up grab post; and said spaced side members of said mounting bracket each defining a curved guide member on an outer periphery of said side members and being engaged by said support plate during rotational movement of said lift-up grab post relative to said mounting bracket, said spaced side members defining a post positioning seat on said outer periphery of said side members and being engaged by said support plate at said open position of said lift-up grab post and further defining a stop shoulder on said outer periphery of said side members adjacent said post positioning seat preventing rotational movement of said lift-up grab post toward said closed position until said lift-up grab post has been raised from said receiver seat to a position clear of said stop shoulder said support plate having an edge portion disposed for stopping said lift-up grab post rotation by engagement with said stop shoulder when said support plate is seated on said post positioning seat.

2. The lift-up safety grab post mechanism of claim 1, comprising:

a grab post rest member being fixed to both of said spaced substantially parallel side plates and defining a rest surface supporting said lift-up grab post at said closed position thereof.

3. The lift-up safety grab post mechanism of claim 1, comprising:

said mounting bracket having curb mount plate fixed thereto and adapted to be positioned on said substantially vertical surface of said generally rectangular hatchway curb; and fasteners extending through fastener holes of said curb mount plate and securing said curb mount plate to said hatchway curb.

4. The lift-up safety grab post mechanism of claim 3, comprising:

a generally horizontally oriented flange extending from said curb mount plate and having engagement with said upper substantially horizontal surface of said hatchway curb; and fasteners extending through fastener holes of said generally horizontally oriented flange and securing said generally horizontally oriented flange to said generally horizontal upper surface of said hatchway curb.

5. The lift-up safety grab post mechanism of claim 1, comprising:

a ladder structure being mounted to said lift-up grab post and being positioned for use at said open position of said lift-up grab post; and at said closed position of said lift-up grab post said ladder structure defining a grate positioned within the curb hatchway opening to minimize the potential for workers or equipment falling through the hatchway opening.

* * * * *